United States Patent [19]

Sprick

[11] 4,354,477

[45] Oct. 19, 1982

[54] MULTI-FUEL CARBURETOR WITH ROTARY MIXING VALVE

[76] Inventor: Ellis H. Sprick, 2855 Flintlock St., Eugene, Oreg. 97401

[21] Appl. No.: 260,348

[22] Filed: May 4, 1981

[51] Int. Cl.[3] ..... F02M 13/00

[52] U.S. Cl. ..... 123/575; 123/576; 123/577; 123/578; 261/18 R

[58] Field of Search ..... 123/575, 576, 577, 179 G; 261/18 R

[56] References Cited

U.S. PATENT DOCUMENTS

| | | | |
|---|---|---|---|
| 2,311,828 | 2/1943 | Hansen et al. | 123/575 |
| 2,465,549 | 3/1949 | Orr, Jr. | 123/575 |
| 2,584,911 | 2/1952 | Orr, Jr. | 123/575 |
| 2,611,593 | 9/1952 | Boyce | 123/575 |
| 2,616,404 | 11/1952 | Bartholomew | 123/577 |
| 3,577,877 | 5/1971 | Warne | 123/575 |
| 4,085,720 | 4/1978 | Etoh | 123/576 |
| 4,090,484 | 5/1978 | Itoh et al. | 123/577 |

*Primary Examiner*—Charles J. Myhre
*Assistant Examiner*—E. Rollins Gross
*Attorney, Agent, or Firm*—James D. Givnan, Jr.

[57] ABSTRACT

A carburetor having a fuel mixing valve with multiple vanes which control the flows of main and secondary fuels into a valve mixing chamber. The octane rating of the fuel charge may be momentarily increased during periods of engine acceleration to permit the engine to have a higher compression ratio for optimum efficiency with a relatively low octane fuel. The fuel flow controlling vanes may be mounted on a common shaft for simultaneous movement or on separate support means for differential movement in response to an engine control. A fuel mixing valve is also disclosed for use with the second stage components of a two stage carburetor.

8 Claims, 7 Drawing Figures

MULTI-FUEL CARBURETOR WITH ROTARY MIXING VALVE

BACKGROUND OF THE INVENTION

The present invention pertains to carburetors and particularly to a carburetor capable of proportionately mixing an auxiliary fuel flow with a primary fuel flow to momentarily raise the fuel octane rating during those periods of engine operation when detonation is likely to occur.

The advantages of utilizing an auxiliary fuel for momentarily increasing an automotive fuel octane rating are set forth in U.S. Pat. No. 2,616,404. Such a concept is of particular interest in view of the use currently of unleaded fuels in automotive engines which have a compression ratio of about 8 to 1. This relatively low compression ratio is below the optimum ratio for most efficient engine operation but does enable acceptable knock-free engine operation throughout a range of operating conditions. Operation of an engine with a higher, more efficient compression ratio, say 9.5 to 1 or higher, would result in harmful detonation of the unleaded fuel particularly during periods of acceleration from low engine speeds.

The above noted patent discloses a fuel system wherein both intake manifold pressure and carburetor venturi pressure are utilized to control the merged flows of main and auxiliary fuels. While provision is made for combining the two flows prior to venturi discharge no consideration is given to the problem resulting from alcohol producing appreciably lower Btu's than a like amount of gasoline. In the prior art fuel system, valves on a common valve stem act to regulate main and auxiliary fuel flows into a nozzle serving passageway. The metering of main and auxiliary fuel flows is within a very limited range with no metering capability of increasing secondary enrichment and requisite Btu's to the fuel charge.

Other examples of dual fuel systems are found in U.S. Pat. Nos. 2,319,773; 3,805,756; 2,321,211; 4,085,720 and 4,090,484 which generically disclose carburetors with multiple fuel bowls, with manifold pressure responsive means controlling the fuel flows past a needle valve or similar valve device.

The use of alcohol as an anti-knock fuel additive is known as mentioned in earlier noted U.S. Pat. No. 2,616,404. Presently alcohol use in automobiles is, for the most part, as an extender termed gasohol wherein alcohol is limited to about ten percent of total fuel volume. Were such use of alcohol widely adopted it is doubtful if the benefits realized justify the increased cost to the consumer. Use of a greater proportion of alcohol is unsuitable in that the drop in the composite fuel Btu's is appreciable with a significant loss of power and poor engine performance.

SUMMARY OF THE PRESENT INVENTION

The present carburetor invention concerns the provision of a carburetor which in addition to a single fuel flow alternatively provides for the mixing of multiple fuel flows in the required proportions to provide an octane change and adequate secondary enrichment without Btu loss during acceleration.

The carburetor includes a valve assembly wherein a rotatable valve component meters the main fuel flow via a first port and, upon demand, admits an auxiliary fuel flow via a second port for mixing with the main fuel. Said auxiliary fuel serves to momentarily increase the octane rating of the fuel flow to the engine thus permitting the use of engines having higher compression ratios more in line with achieving optimum fuel economy.

A main port within the present valve assembly is enlarged during engine acceleration to admit fuel to provide secondary enrichment for uninterrupted engine operation during acceleration. Accordingly, the proportion of unleaded gasoline to the auxiliary fuel, such as for example alcohol, is sufficient to at all times provide a fuel mixture of adequate Btu's. A second port within the valve assembly discharges the auxiliary fuel into a valve mixing chamber upon the port being opened by a rotated vane of the valve assembly. Both the main and auxiliary ports are geometric openings of dissimilar size with the main fuel port serving as a main metering jet and at all times partially open to provide fuel during normal (or non-acceleration) engine operation. That portion of the main fuel port which is normally closed is analogous to the normally closed secondary enrichment jet of a conventional carburetor. The rotatable vane member component of the valve assembly is coupled by suitable control linkage to a control such as an on-board computer, oxygen sensor or a diaphragm valve responsive to negative pressures within the fuel induction system of the engine.

Objectives of the present invention include the provision of a valve assembly for use with a carburetor wherein said valve assembly includes multiple ports metering main and auxiliary fuel flows with each flow controlled by an arcuately positionable vane member; the provision of a valve assembly in combination with other carburetor components wherein a main and an auxiliary fuel flow are mixed within a valve assembly mixing chamber without loss of Btu's in the fuel charge; the provision of a valve assembly within a single or two stage carburetor wherein rotary vane members serve to vary the size of a main fuel port and additionally to open and close an auxiliary fuel port in response to engine demands relayed through control means such as an on-board computer; the provision of a modified valve assembly defining both a main fuel port and an auxiliary fuel port with the flow from each port being regulated by a vane member with each vane member capable of independent port opening and closing movement; the provision of a valve assembly defining a main fuel port the effective size of which is controlled by a rotational vane which is independent of a second rotational vane which opens and closes an auxiliary fuel port; the provision of a valve assembly which permits mixing of the main and auxiliary fuels to effect a transient multi-fuel charge having a higher octane rating to preclude engine detonation of the charge during periods of engine acceleration; the provision of a fuel mixing valve in the proximity of a carburetor venturi to reduce engine response time.

BRIEF DESCRIPTION OF THE DRAWINGS

In the accompanying drawings.

DETAILED DESCRIPTION OF THE PREFERRED EMBODIMENTS

Figure 1:
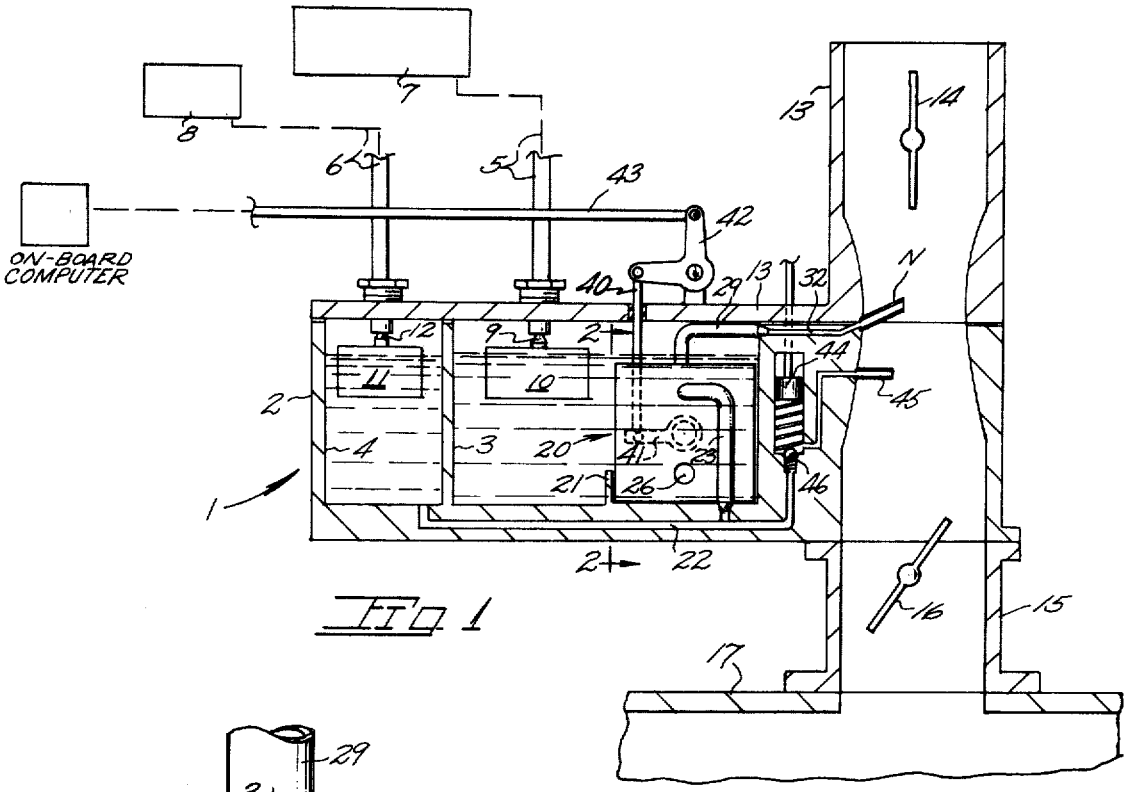
FIG. 1 is a schematic view of a carburetor shown in section in combination with the present valve assembly.

With continuing attention to the accompanying drawings wherein applied reference numerals indicate parts similarly hereinafter identified, the reference numeral 1 indicates generally a carburetor having a fuel bowl assembly 2 defining a main fuel bowl 3 and an auxiliary or secondary fuel bowl 4. The fuel bowls are served respectively by fuel lines 5 and 6 in upstream communication with a main fuel tank 7 and an auxiliary fuel tank 8. Floats at 10 and 11 control the flow of incoming fuel via needle valves 9 and 12. The foregoing described portion of a carburetor may be termed typical of prior art carburetor construction. The fuel tank flows may be delivered by a fuel pump or pumps.

Indicated at 13 is an air horn assembly within which is a choke valve 14 responsive to a control such as an automatic choke assembly (not shown). A throttle assembly at 15 includes a throttle valve 16 coupled to an engine throttle linkage. Shown in fragmentary form ony is an engine intake manifold at 17 having an internal area in communication with engine components receiving a fuel-air charge.

With attention again to the bowl assembly 2, only those features are disclosed necessary to an understanding of the present invention as it is to be understood that remaining carburetor components required for carburetor operation are well known to those skilled in the art and which components may operate substantially in the known manner.

A valve assembly is indicated generally at 20 and may be of modular construction for disposition within main fuel bowl 3 of the carburetor. Means at 21 confines the modular valve assembly against displacement yet permits removal of same such as for servicing purposes. The valve assembly may be partially submerged within main fuel bowl 3 to simplify delivery of a fuel to said assembly. An auxiliary fuel flow is via a passageway at 22 in the fuel bowl assembly in communication with a conduit 23.

Figure 2:
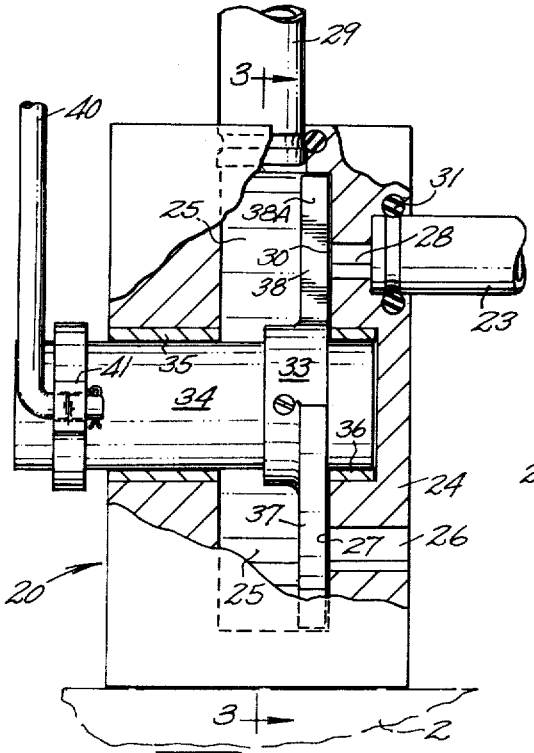
FIG. 2 is a vertical elevational view taken along line 2—2 of FIG. 1 showing the present valve assembly with fragments broken away for purposes of illustration.
Figure 3:
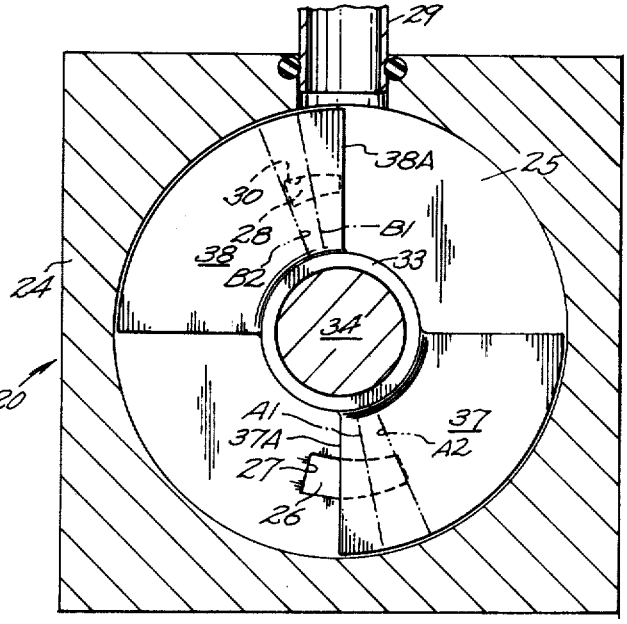
FIG. 3 is a vertical sectional view taken along line 3—3 of FIG. 2 showing the vanes of the present valve assembly.

With attention now to FIGS. 2 and 3, valve assembly 20 includes a main body 24 which defines a circular fuel mixing chamber 25. Main body 24 of the valve assembly additionally defines a main fuel inlet 26 terminating inwardly in a main port 27 the size of which may be regulated by a later described vane member. An auxiliary fuel inlet at 28 similarly terminates inwardly in a secondary port 30 which is regulated by a remaining vane member also later elaborated upon. Fuel flows to main fuel inlet 26 may be by immersion of valve body 24 in fuel bowl confined gasoline while conduit 23 provides an auxiliary flow to auxiliary fuel inlet 28 with the conduit end retained in place by an O-ring 31 or other suitable means. Outlet means 29 receives fuel from mixing chamber 25 and directs same to a passageway 32 for discharge at a venturi discharge nozzle N. Importantly for purposes of engine responsiveness, valve assembly 20 is proximate the carburetor discharge nozzle.

A rotary valve component at 33 is supported on a shaft 34 the latter rotatably mounted within bushings 35 and 36 within the main valve body. Valve component 33 includes a primary vane 37 for controlling the main fuel flow and a secondary vane 38 which controls the secondary or auxiliary fuel flow into mixing chamber 25. Rotation of shaft 34 and hence vanes 37–38 may be by a control rod 40 coupled at its lower end with a shaft mounted arm 41. Control rod 40 terminates upwardly in motion translating means such as a bellcrank 42. Bellcrank linkage at 43 is responsive to a control unit such as an on-board computer or a vacuum diaphragm valve. From the foregoing it will be seen that bellcrank movement will impart rotational movement to valve component 33 and specifically vanes 37 and 38 thereon to vary the effective size of main and secondary ports 27 and 30 as vane edges 37A–38B move therepast. Intermediate open positions of vanes 37 and 38 are indicated respectively at A1 and B1 with full open positions indicated at A2 and B2.

During cruising (non-accelerating) operation of the engine, valve component 33 remains stationary in which instance the exposed (full line) portion of main inlet 26 as viewed in FIG. 3 is of an area to function as a main metering jet of the carburetor. Secondary port 30 is fully closed by vane 38 at this time resulting in only main fuel flowing into mixing chamber 25 and ultimately into the carburetor venturi.

During periods of engine acceleration, the engine control imparts in a counterclockwise direction in FIG. 3 to shaft 34 and valve component 33 to cause vanes 37–38 to move to a position such as A1–A2; B1–B2 whereat the area of main inlet port 27 is increased and secondary port 30 opened. Accordingly port 27 importantly now provides secondary enrichment, i.e., increased main fuel flow to mixing chamber 25. Simultaneously vane 38 has moved to a partially open position as at B1 or a full open position at B2 to admit a flow of auxiliary fuel to the mixing chamber. The size and configuration of the main and secondary fuel ports at 27 and 30 will of course vary with engine displacement and operating criteria of the engine. When alcohol is used as the auxiliary fuel, the maximum proportion of same to gasoline in the fuel charge should not exceed about thirty percent.

An accelerator pump piston is disclosed at 44 which is actuated by throttle movement in a conventional manner to discharge the auxiliary or secondary fuel into the carburetor venturi via a pump jet 45. A ball check valve 46 is spring biased to a raised open or floating position and which valve closes off passageway 22 during rapid pump piston movement to direct fuel to the pump jet.

Figure 4:
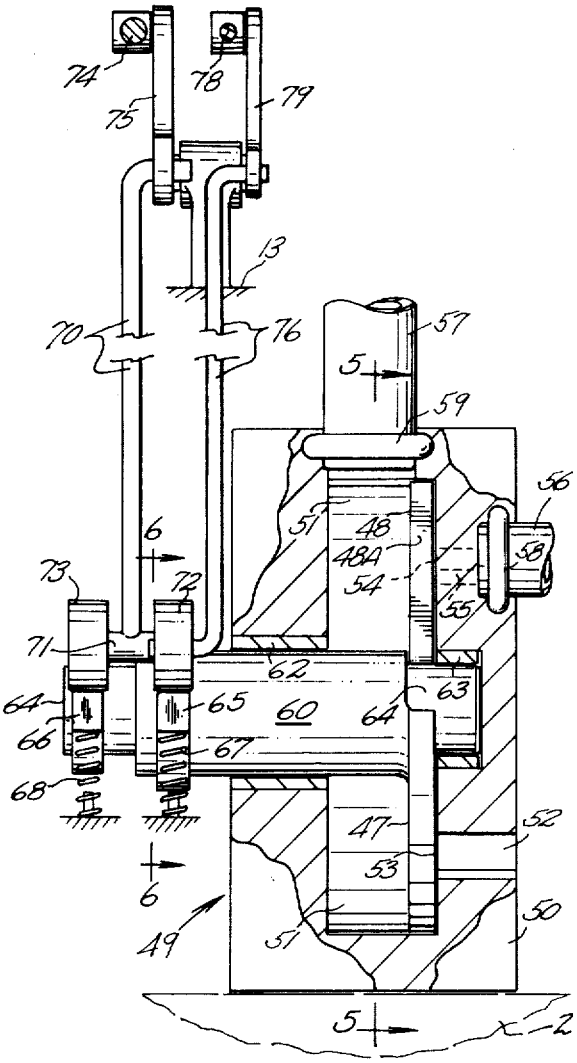
FIG. 4 is a view similar to FIG. 2 but showing a modified form of valve assembly.
Figure 5:
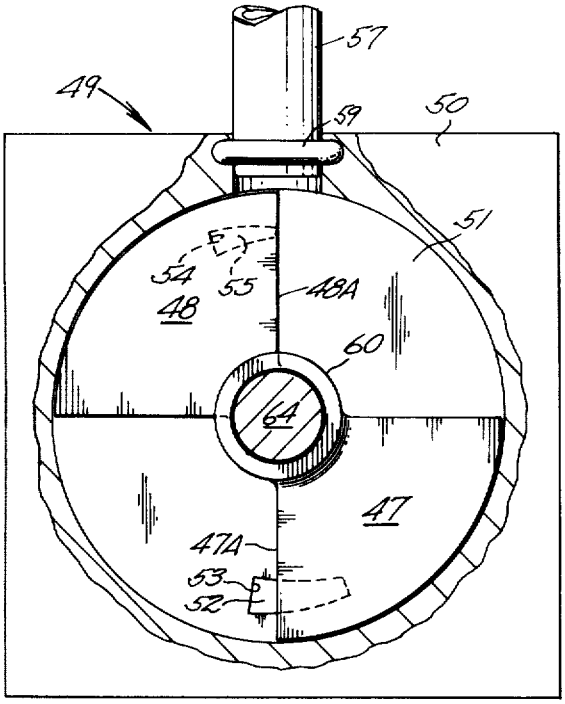
FIG. 5 is a vertical sectional view taken along line 5—5 of FIG. 4 showing the independent vanes of the modified valve assembly.

A modified form of the valve assembly is shown generally at 49 in FIGS. 4 and 5 which views are analogous to FIGS. 2 and 3 of the preferred form of valve assembly. In this latter form of valve assembly primary and secondary vanes at 47 and 48 are capable of arcuate rotational movement relative one another. A main valve body at 50 defines a fuel mixing chamber 51 and a main fuel inlet at 52 terminating inwardly at a main fuel port 53. Vane 47 controls the effective size of main port 53 while vane 48 controls the effective size of auxiliary fuel port 54 at the inner end of an inlet 55. Fuel is conveniently admitted to inlet 52 by reason of the valve assembly being immersed in the fuel of the main fuel bowl while as before, auxiliary fuel is directed to auxiliary inlet 55 by a conduit at 56. Outlet means is shown as a conduit 57 which delivers fuel from mixing chamber 51 to a venturi located nozzle as in the first described form of the invention. O-rings at 58 and 59 may be used to couple the conduit ends to the valve body.

In this latter valve assembly a rotary valve component is of segmented construction to permit differential movement of the valve vanes 47 and 48. Main fuel regulating vane 47 is carried by a tubular sleeve 60 suitably journaled within bushings 62. Auxiliary fuel regulating vane 48 is carried by the inner end segment of a shaft 64 journaled within a bushing 63 and rotatably within sleeve 60. Secured respectively to tubular sleeve 60 and shaft 64 are arms 65 and 66 each resiliently supported by spiral springs 67 and 68 which locate their associated vanes as shown in FIG. 5. A control rod 70 terminates downwardly in a crosspiece 71 on which are mounted arm actuators 72 and 73. Accordingly, axial motion of a bellcrank linkage at 74 moves a bellcrank at 75 to actuate control rod 70 and hence position both main and secondary fuel flow controlling vanes 47 and 48. As before, linkage 74 may be coupled to engine control means such as an on-board computer or a vacuum responsive diaphragm valve.

Main fuel port 53 defines a geometric opening of a size comparable to a main metering jet of a conventional carburetor for a like engine. Counterclockwise or opening movement of vane edge 47A admits an additional or a secondary enrichment flow into mixing chamber 51 during engine acceleration. Edge 48A of the secondary fuel controlling vane 48 simultaneously opens secondary fuel port 54 for the admission of an octane raising fuel flow into the mixing chamber.

Figure 6:
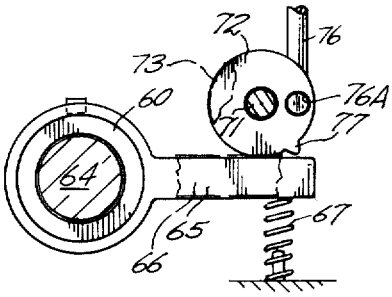
FIG. 6 is a vertical sectional view taken along line 6—6 of FIG. 4 showing details of a valve control arrangement.
Figure 7:
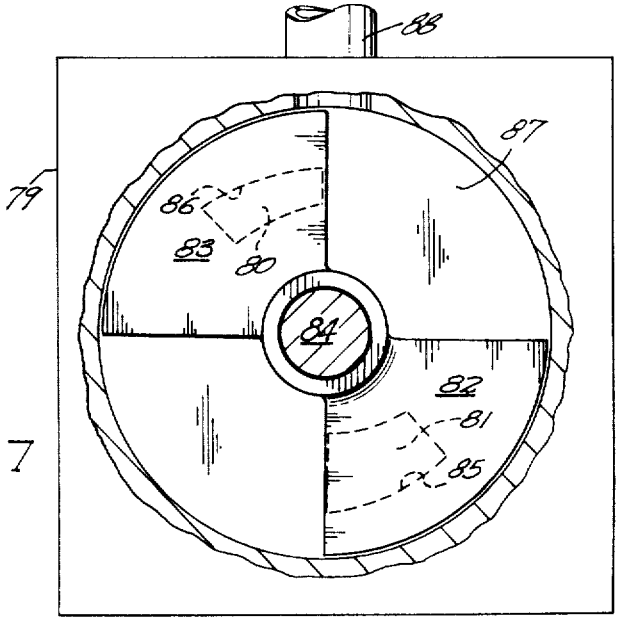
FIG. 7 is a view similar to FIGS. 3 and 5 but showing a modified valve assembly for use on a two stage carburetor.

Provision is made for independent control of main fuel vane 47 to permit positioning same to vary the static size of main fuel port 53 without affecting auxiliary fuel port 54. Similarly, an oxygen sensor in an automotive fuel system may be used as the source of a signal to regulate the area of main fuel port 53. To accomplish the foregoing, a main fuel control rod at 76 rotatably and eccentrically engages at 76A a rotatable arm actuator 72, per FIG. 6, to permit rotation of same about the axis of a crosspiece spindle 71 to cause a lobe 77 on actuator 72 to act on arm 65 while crosspiece 71 remains fixed. Engine control linkage at 78 imparts axial movement to rod 76 via a bellcrank 79.

The present valve assembly is equally adaptable to use with a carburetor having a second stage wherein provision is typically made for both supplemental air and fuel flows which are introduced during periods of acceleration into the manifold via additional carburetor openings or barrels. In this latter use a valve main body 79 defines inlet openings at 80 and 81 both of which are closed during cruise or non-acceleration operation of the engine. In response to the engine control first and second vanes at 82 and 83 are also rotated in a counterclockwise direction by a shaft 84 of a rotary valve component to simultaneously open both a primary fuel port 85 and a secondary fuel port 86 of unequal area. A mixing chamber 87 is in communication with the second stage barrels via outlet means 88.

While not shown in the drawing, a primary fuel accelerator pump is provided in the carburetor and is functional during cold starting and warm-up periods in conjunction with automatic choke operation. At other times, the accelerator pump disclosed functions to inject the secondary fuel into the carburetor venturi during rapid throttle movement as earlier noted. A conventional idle system using primary fuel is also utilized.

The present mixing valve and carburetor combination by using alcohol only on demand renders existing alcohol producing facilities capable of meeting current demands as opposed to the proposed use of alcohol only as a fuel extender in the ratio of about ten percent to gasoline.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. In combination with a carburetor having a fuel discharge nozzle for discharging fuel into the carburetor venturi, the improvement comprising a multi-fuel regulating valve assembly for mixing fuels of different Btu's and permitting the varying of a fuel charge octane rating, said valve assembly comprising in combination, a main valve body defining first and second fuel inlets each inlet adapted for communication with a source of fuel of a different octane rating, said body also defining a fuel mixing chamber downstream from the first and second inlets, outlet means communicating the mixing chamber with the carburetor discharge nozzle, a valve component rotatably mounted in said main valve body and including a first vane operable to alter the effective size of a first fuel inlet port at the innermost end of said first fuel inlet, a second vane operable to open and subsequently alter the effective size of said second fuel inlet port at the innermost end of the second fuel inlet, control means coupling the rotatably mounted valve component with an engine speed control, and said first vane operable to regulate fuel flow through the first fuel inlet during constant speed operation of the engine and an increased fuel flow during acceleration periods of engine operation, said second vane operable to regulate a second fuel flow through the second fuel inlet to the mixing chamber during acceleration periods of engine operation to increase the octane rating of the fuel charge while the increased first mentioned fuel flow provides adequate fuel charge Btu's.

2. The improvement claimed in claim 1 wherein said valve assembly is of modular construction.

3. The improvement claimed in claim 2 wherein said valve assembly is adapted for submersed disposition within a carburetor fuel bowl.

4. The improvement claimed in claim 1 wherein said valve component has segmented first and second vanes independently rotatably mounted in said main valve body.

5. The improvement claimed in claim 4 wherein said control means additionally includes means coupled to said first vane and operable to position same without affecting said second vane.

6. The improvement claimed in claim 5 wherein said coupled means includes a control rod, a rotatable arm actuator having a cam lobe thereon, said rod coupled at one end to said rotatable arm actuator, an arm acted on by said actuator cam lobe, shaft means coupling said arm to said first vane.

7. The improvement claimed in claim 1 wherein said first and second vanes of the valve component normally close the first and second inlet ports during engine operation, said control means serving to rotate said vanes to open same substantially simultaneously to provide a combined fuel flow from said ports to the valve mixing chamber and second stage components of a two stage carburetor.

8. In combination with a carburetor having a fuel discharge jet for discharging fuel into a carburetor air intake, the improvement comprising a multi-fuel regulating valve assembly for mixing fuels of different Btu's and permitting the varying of a fuel charge octane rating, said valve assembly comprising in combination, a main valve body defining first and second fuel inlets each inlet adapted for communication with a source of fuel of a different octane rating, said body also defining a fuel mixing chamber downstream from the first and second inlets, outlet means communicating the mixing chamber with the carburetor discharge jet, a valve component rotatably mounted in said main valve body and including a first vane operable to open the first fuel inlet port at the innermost end of said first fuel inlet, a second vane operable to open a second fuel inlet port at the innermost end of the second fuel inlet, and control means coupling the rotatably mounted valve component with an engine speed control.

* * * * *